US009871304B2

(12) United States Patent
Shin et al.

(10) Patent No.: US 9,871,304 B2
(45) Date of Patent: Jan. 16, 2018

(54) ANTENNA DEVICE AND ELECTRONIC DEVICE INCLUDING THE SAME

(71) Applicant: Samsung Electronics Co., Ltd., Suwon-si, Gyeonggi-do (KR)

(72) Inventors: Dong-Ryul Shin, Daegu (KR); Min Sakong, Gumi-si (KR); Joon-Bo Park, Busan (KR); Byung-Chan Jang, Gumi-si (KR); Soo-Young Jang, Daegu (KR); Jin-Woo Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/878,468

(22) Filed: Oct. 8, 2015

(65) Prior Publication Data

US 2016/0111797 A1 Apr. 21, 2016

(30) Foreign Application Priority Data

Oct. 17, 2014 (KR) ..... 10-2014-0140649

(51) Int. Cl.

| | |
|---|---|
| ***H01Q 1/24*** | (2006.01) |
| ***H01Q 21/30*** | (2006.01) |
| ***H01Q 1/38*** | (2006.01) |
| ***H01Q 13/10*** | (2006.01) |
| ***H01Q 5/364*** | (2015.01) |

(52) U.S. Cl.

CPC ..... *H01Q 21/30* (2013.01); *H01Q 1/243* (2013.01); *H01Q 1/38* (2013.01); *H01Q 5/364* (2015.01); *H01Q 13/10* (2013.01)

(58) Field of Classification Search

CPC ..... H01Q 1/243; H01Q 21/30; H01Q 13/00; H01Q 5/364

USPC ..... 343/700 MS, 702

See application file for complete search history.

(56) References Cited

U.S. PATENT DOCUMENTS

| | | | | |
|---|---|---|---|---|
| 2004/0145525 | A1* | 7/2004 | Annabi | H01Q 1/243 343/700 MS |
| 2006/0103577 | A1 | 5/2006 | Lee | |
| 2008/0231531 | A1* | 9/2008 | Wang | H01Q 1/243 343/767 |
| 2011/0001669 | A1 | 1/2011 | Wang et al. | |
| 2012/0194390 | A1* | 8/2012 | Endo | H01Q 1/243 343/700 MS |
| 2013/0126225 | A1 | 5/2013 | Toyao | |
| 2013/0285860 | A1 | 10/2013 | Lai et al. | |
| 2014/0009342 | A1 | 1/2014 | Wei | |

(Continued)

FOREIGN PATENT DOCUMENTS

KR 10-2009-0001016 A 1/2009

*Primary Examiner* — Dieu H Duong

(74) *Attorney, Agent, or Firm* — Jefferson IP Law, LLP

(57) ABSTRACT

An antenna device and an electronic device including the same are provided. The antenna device includes a first radiator in which a slot is formed, a second radiator, at least a portion of which is disposed in the slot, and a feeder configured to feed the same electricity to the first radiator and the second radiator. The antenna device may have many resonance frequencies in the same installation space, allowing efficient use of the internal space of the electronic device. Moreover, the antenna device and the electronic device including the same may be implemented variously according to various embodiments.

11 Claims, 8 Drawing Sheets

(56) References Cited

U.S. PATENT DOCUMENTS

2014/0015720 A1* 1/2014 Handro ..... H01Q 5/0031
343/745

* cited by examiner

ANTENNA DEVICE AND ELECTRONIC DEVICE INCLUDING THE SAME

CROSS-REFERENCE TO RELATED APPLICATION(S)

This application claims the benefit under 35 U.S.C. §119 (a) of a Korean patent application filed on Oct. 17, 2014 in the Korean Intellectual Property Office and assigned Serial number 10-2014-0140649, the entire disclosure of which is hereby incorporated by reference.

TECHNICAL FIELD

The present disclosure relates to an electronic device. More particularly, the present disclosure relates to an antenna device and an electronic device including the same.

BACKGROUND

An electronic device performs a particular function according to an embedded program, such as mobile communication terminal, a tablet personal computer (PC), a video/audio device, a desktop/laptop PC, a vehicle navigation system, or the like. For example, the electronic device may output stored information as audio or video. As the integration of an electronic devices has increased and ultra-high-speed wireless communication has come into common use, various functions are integrated into a single mobile communication terminal. For example, a communication function, an entertainment function such as a game, multimedia function for playback of music/video, communication and security functions for mobile banking, and a schedule management function, or a financial function such as an electronic wallet, have been integrated in a single electronic device.

To enable wireless communication, an antenna is required. The antenna device is installed with a sufficient distance from other circuit devices to suppress interference with the circuit devices during transmission and reception of high-frequency signals. An electronic device which performs ultra-high-speed wireless communication according to 4th-generation (4G) mobile communication standards, such as long term evolution (LTE) communication standards, connect to a communication network through various frequency bands. For connection in various frequency bands with a single electronic device, an antenna device may include as many radiators as the number of frequency bands.

When an antenna device is installed in an electronic device, a sufficient distance from other circuits is required for suppression of interference with the circuit devices, which requires a large space for installation of the antenna device. Thus, it is difficult to efficiently use an internal space of the electronic device in the installation of the antenna device.

The above information is presented as background information only to assist with an understanding of the present disclosure. No determination has been made, and no assertion is made, as to whether any of the above might be applicable as prior art with regard to the present disclosure.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages disadvantages described below. Accordingly, an aspect of the present disclosure is to provide an antenna device capable of guaranteeing stable radiation performance while occupying a small space for installation thereof and an electronic device including the antenna device.

Another aspect of the present disclosure is to provide an antenna device including a plurality of radiators and providing stable radiation performance without mutual interference between the radiators, and an electronic device including the antenna device.

Other aspects to be provided in the present disclosure may be understood by various embodiments described below.

In accordance with an aspect of the present disclosure, an antenna device is provided. The antenna device includes a first radiator in which a slot is formed, a second radiator, at least a portion of which is disposed in the slot, and a feeder configured to feed the same electricity to the first radiator and the second radiator.

The first radiator and the second radiator may operate independently of each other by being fed with the same electricity, thus securing stable radiation performance.

In accordance with another aspect of the present disclosure, an electronic device is provided. The electronic device includes a first radiator in which a slot is formed, and a second radiator, at least a portion of which is disposed in the slot, and which is fed with the same electricity as electricity fed to the first radiator, in which the first radiator and the second radiator form resonance frequencies in different frequency bands.

The electronic device makes it easy to install radiators operating in different frequency bands even in a small installation space.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of a certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
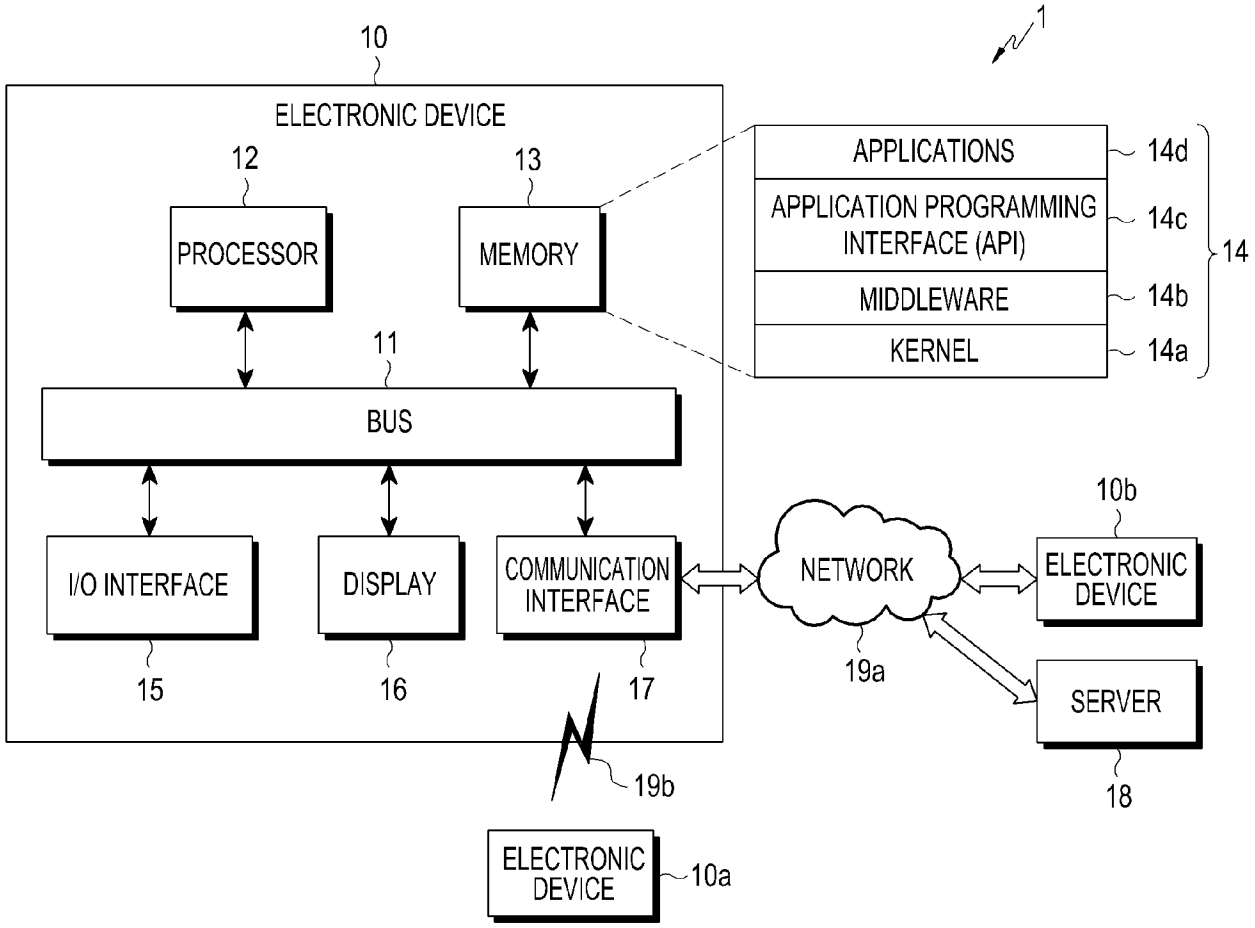
FIG. 1 illustrates an environment where an electronic device operates according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Although ordinal numbers such as "first", "second", and so forth will be used to describe various components of the present disclosure, those components are not limited by the terms. The terms are used only for distinguishing one component from another component. For example, a first component may be referred to as a second component and likewise, a second component may also be referred to as a first component, without departing from the teaching of the inventive concept. The term "and/or" used herein includes any and all combinations of one or more of the associated listed items.

Relative terms used based on illustration in the drawings, such as a "front side", a "rear side", a "top surface", a "bottom surface", and the like, may be replaced with ordinal numbers such as "first", "second", and the like. The order of the ordinal numbers such as "first", "second", and the like is a mentioned order or an arbitrarily set order, and may be changed as needed.

The terminology used herein is for the purpose of describing an embodiment only and is not intended to be limiting of an embodiment. It will be further understood that the terms "comprises" and/or "has" when used in this specification, specify the presence of a stated feature, number, operation, component, element, or a combination thereof but do not preclude the presence or addition of one or more other features, numbers, operations, components, elements, or combinations thereof.

Unless defined otherwise, all terms used herein have the same meanings as generally understood by those having ordinary knowledge in the technical field to which the present disclosure pertains. Terms generally used and defined in dictionaries should be interpreted as having meanings consistent with meanings construed in the context of the related art, and should not be interpreted as having ideal or excessively formal meanings unless defined explicitly in this application.

In various embodiments of the present disclosure, an electronic device may be a device having a touch panel and may be referred to as a terminal, a portable terminal, a mobile terminal, a communication terminal, a portable communication terminal, a portable mobile terminal, a display, or the like.

For example, the electronic device may be a smart phone, a cellular phone, a navigation device, a game console, a television (TV), a vehicle head unit, a laptop computer, a tablet computer, a personal media player (PMP), a personal digital assistant (PDA), or the like. The electronic device may be implemented with a pocket-size portable communication terminal having a wireless communication function. The electronic device may be a flexible device or include a flexible display.

The electronic device may communicate with an external electronic device such as a server or may work by cooperating with another external electronic device. For example, the electronic device may transmit an image captured by a camera and/or position information detected by a sensor unit to the server over a network. The network may be, but not limited to, a mobile or cellular communication network, a local area network (LAN), a wireless LAN (WLAN), a wide area network (WAN), Internet, or a small area network (SAN).

FIG. 1 illustrates an environment where an electronic device operates according to various embodiments of the present disclosure.

Referring to FIG. 1, an electronic device 10 in a network environment 1 according to various embodiments of the present disclosure may include a bus 11, a processor 12, a memory 13, an input/output (I/O) interface 15, a display 16, and a communication interface 17. According to various embodiments, the electronic device 10 may omit at least one of the foregoing elements or may further include other elements.

The bus 11 may include a circuit for interconnecting the elements 11 through 17 described above and for allowing communication (for example, a control message and/or data) between the elements 11 through 17.

The processor 12 may include one or more of a central processing unit (CPU), an application processor (AP), and a communication processor (CP). The processor 12 performs operations or data processing for control and/or communication of, for example, at least one other elements of the electronic device 10.

The memory 13 may include a volatile and/or nonvolatile memory. The memory 13 may store, for example, commands or data associated with at least one element of the electronic device 10. According to an embodiment of the present disclosure, the memory 13 may store software and/or a program 14. The program 14 may include, for example, a kernel 14*a*, middleware 14*b*, an application programming interface (API) 14*c*, and/or an application program (or an application) 14*d*. At least some of the kernel 14*a*, the middleware 14*b*, and the API 14*c* may be referred to as an operating system (OS).

The kernel 14*a* controls or manages, for example, system resources (for example, the bus 11, the processor 12, or the memory 13) used to execute an operation or a function implemented in other programs (for example, the middleware 14*b*, the API 14*c*, or the application program 14*d*). The kernel 14*a* provides an interface through which the middleware 14*b*, the API 14*c*, or the application program 14*d* accesses separate components of the electronic device 10 to control or manage the system resources.

The middleware 14*b* may work as an intermediary for allowing, for example, the API 14*c* or the application program 14*d* to exchange data in communication with the kernel 14*a*. In regard to task requests received from the application program 14*d*, the middleware 14*b* performs control (for example, scheduling or load balancing) with respect to the task requests, for example, by giving priorities for using a system resource (for example, the bus 11, the processor 12, or the memory 13) of the electronic device 10 to at least one of the application programs 14*d*.

The API 14*c* is an interface used for the application 14*d* to control a function provided by the kernel 14*a* or the middleware 14*b*, and may include, for example, at least one interface or function (for example, a command) for file control, window control, image processing or character control.

The I/O interface 15 serves as an interface for delivering a command or data input from a user or another external device to components 11 through 17 of the electronic device 10. The I/O interface 15 may also output a command or data received from components 11 through 17 of the electronic device 10 to a user or another external device.

The display 16 may include, for example, a liquid crystal display (LCD), a light emitting diode (LED) display, an Organic LED (OLED) display, a microelectromechanical System (MEMS) display, or an electronic paper display. The display 16 may display various contents (for example, a text, an image, video, an icon, or a symbol) to users. The display 16 may include a touch screen, and receives a touch, a gesture, proximity, or a hovering input, for example, by using an electronic pen or a part of a body of a user.

The communication interface 17 sets up communication, for example, between the electronic device 10 and an external device (for example, a first external electronic device 10*a*, a second external electronic device 10*b*, or a server 18). For example, the communication interface 17 is connected to networks 19*a* and 19*b* through wireless or wired communication to communicate with the external device (for example, the second external electronic device 10*b* or the server 18).

The wireless communication may use a cellular communication protocol, for example, at least one of long term evolution (LTE), LTE-advanced (LTE-A), code division multiple access (CDMA), wideband CDMA (WCDMA), a universal mobile telecommunication system (UMTS), wireless Broadband (WiBro), or global system for mobile communications (GSM). The wired communication may include, for example, at least one of a universal serial bus (USB), a high definition multimedia interface (HDMI), a recommended standard (RS)-232, and a plain old telephone service (POTS). The network 19*a* may include a telecommunications network, for example, at least one of a computer network (for example, a LAN or a WAN), Internet, and a telephone network.

Each of the first external electronic device 10*a* and the second external electronic device 10*b* may be a device of the same type or a different type than the electronic device 10. According to an embodiment of the present disclosure, the server 18 may include a group of one or more servers. According to various embodiments of the present disclosure, some or all of operations performed by the electronic device 10 may be performed in other one or more electronic devices (for example, the electronic devices 10*a* and 10*b* or the server 18). According to an embodiment of the present disclosure, when the electronic device 10 has to perform a function or a service automatically, the electronic device 10 may request another device (for example, the electronic device 10*a* or 10*b* or the server 18) to execute at least some functions associated with the function or the service, in place of or in addition to executing the function or the service. Another electronic device (for example, the electronic device 10*a* or 10*b* or the server 18) may execute the requested function or additional function and deliver the execution result to the electronic device 10. The electronic device 10 may then process or further process the received result to provide the requested function or service. To this end, for example, cloud computing, distributed computing, or client-server computing may be used.

The various embodiments disclosed herein have been provided for description and understanding of disclosed technical matters, and are not intended to limit the scope of the present disclosure. Therefore, it should be construed that the scope of the present disclosure includes any change or other various embodiments based on the technical spirit of the present disclosure.

Figure 2:
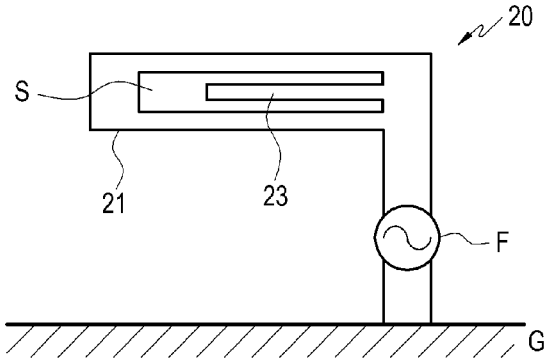
FIG. 2 is a diagram of an antenna device according to an embodiment of the present disclosure.

FIG. 2 is a diagram of an antenna device according to an embodiment of the present disclosure.

When various embodiments of the present disclosure are described, a radiator in which a slot is formed may be referred to as a 'first radiator' in an embodiment and as a 'second radiator' in another embodiment. This reference distinguishes different radiators from each other by indicating a radiator having a longer wavelength of a resonance frequency formed by the radiator using a prior order, and in terms of a structure, the 'first radiator' in an embodiment may be implemented to be similar with the 'second radiator' in another embodiment.

An antenna device according to various embodiments of the present disclosure includes a first radiator in which a slot is formed and a second radiator, at least a portion of which is disposed in the slot, in which the first radiator and the second radiator may be fed with the same electricity from a feeder. While the feeder is directly connected with the first radiator and the second radiator in a detailed embodiment of the present disclosure, the present disclosure is not limited thereto. For example, the first radiator may be fed with the electricity by forming capacitive coupling with the feeder.

Referring to FIG. 2, the antenna device 20 according to an embodiment of the present disclosure may include a first radiator 21 in which a slot S is formed and a second radiator 23 disposed in the slot S. For example, the second radiator 23 may be entirely disposed in the slot S. The first radiator 21 and the second radiator 23 may be excited by being fed with the same electricity from a feeder F. When the same electricity is fed, the first radiator 21 may operate as a slot antenna and the second radiator 23 may operate as a planar type inverted-F antenna (PIFA). In the present disclosure, the first radiator 21 and the slot S are illustrated as a rectangular shape, but the shape is not necessarily limited to the rectangular shape. For example, the first radiator 21 may have a closed-curve shape. According to various embodiments of the present disclosure, at least a portion of the second radiator 23 may be planar with the first radiator 21. For example, at least the portion of the second radiator 23 planar with the first radiator 21 may be a portion of the second radiator 23 which is disposed in the slot S.

Figure 3:
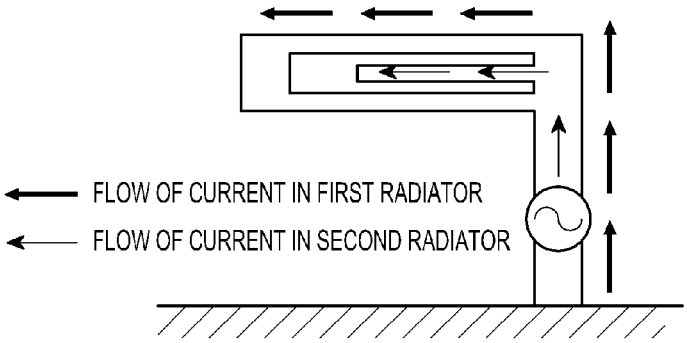
FIG. 3 is a view illustrating a flow of a signal current of an antenna device according to an embodiment of the present disclosure.

FIG. 3 is a view illustrating a flow of a signal current of the antenna device 20 according to of the present disclosure.an embodiment Referring to FIG. 3, when the same electricity is fed to the first radiator 21 and the second radiator 23, a (electrical) length of a path through which current flows to the first radiator 21 and the second radiator 23 may be longer in the first radiator 21 than in the second radiator 23. The electrical length of the radiator may be set to ¼ of a resonance frequency wavelength such that the wavelength of a resonance frequency formed by the first radiator 21 may be longer than that formed by the second radiator 23. Thus, in the antenna device 20 according to the current embodiment, the second radiator 23 may have a higher resonance frequency than the resonance frequency of the first radiator 21.

Figure 4:
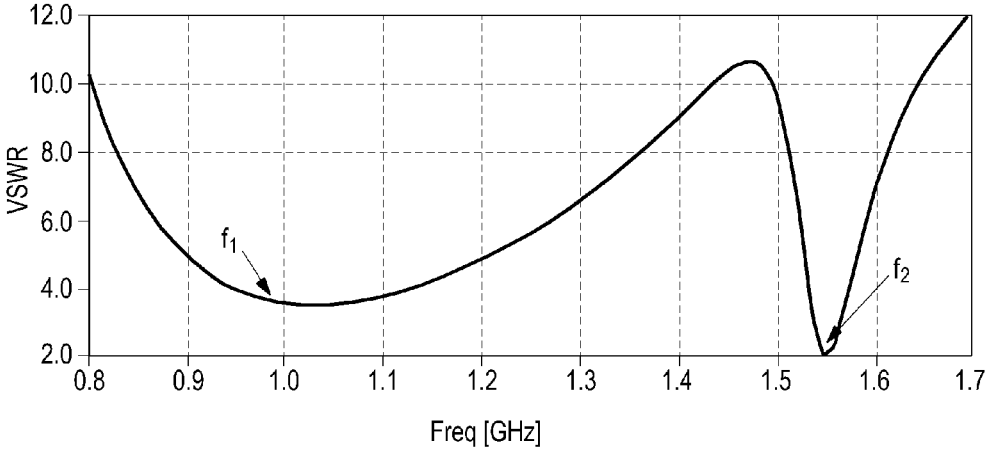
FIG. 4 is a graph showing resonance characteristics of an antenna device according to an embodiment of the present disclosure.

FIG. 4 is a graph showing resonance characteristics of the antenna device 20 according to an embodiment of the present disclosure.

Referring to FIG. 4, a graph illustrates a measurement result of a voltage standing wave ratio (VSWR) of the antenna device 20, from which it can be seen that the antenna device 20 forms a first resonance frequency $f_1$ of a frequency band of about 1 GHz and a second resonance frequency $f_2$ of a frequency band of about 1.55 GHz. The first resonance frequency $f_1$ may be formed by the first radiator 21 and the second resonance frequency $f_2$ may be formed by the second radiator 23. The first radiator 21 and the second radiator 23 are excited by being fed with the same electricity such that interference caused by coupling between signal currents flowing through the first radiator 21 and the second radiator 23 may be suppressed even when the first radiator 21 and the second radiator 23 are disposed adjacent to each other. For example, the first radiator 21 and the second radiator 23 may stably maintain their independent radiation performances while being disposed adjacent to each other.

Figure 5:
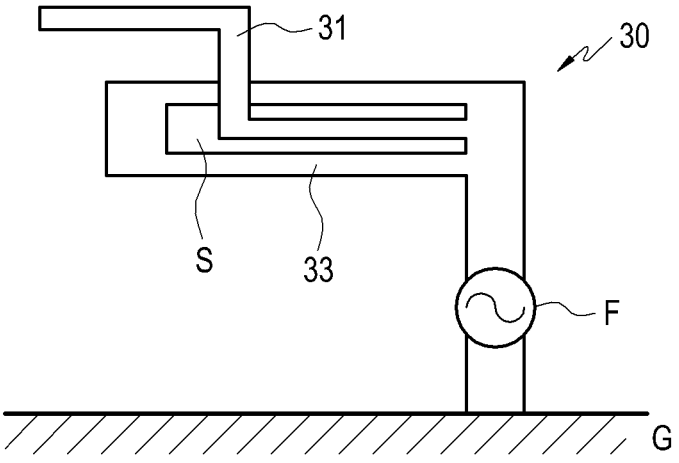
FIG. 5 is a diagram of an antenna device according to an embodiment of the present disclosure.

FIG. 5 is a diagram of an antenna device according to an embodiment of the present disclosure.

Figure 6:
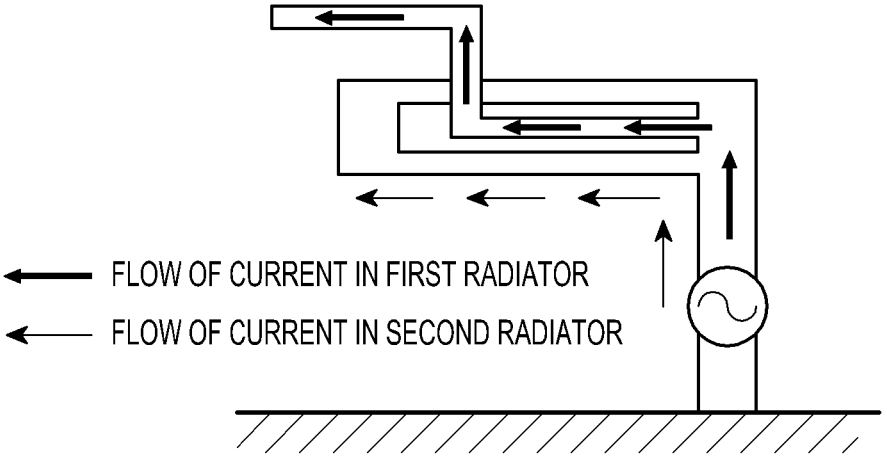
FIG. 6 is a view illustrating a flow of a signal current of an antenna device according to an embodiment of the present disclosure.

Referring to FIGS. 5 and 6, at least a portion of a first radiator 31 of the antenna device 30 may be disposed in a slot S formed in a second radiator 33. Another portion of the first radiator 31 may be disposed outside the slot S. Although the first radiator 31 and the second radiator 33 partially overlap, the radiators 31 and 33 may be electrically insulated from each other. For example, if the first radiator 31 and the second radiator 33 are implemented as a conductive pattern formed on a multi-layer printed circuit board (PCB), the overlapping portions may be implemented on different layers of the multi-layer PCB.

FIG. 6 is a view illustrating a flow of a signal current of the antenna device 30 according to of the present disclosure.an embodiment Referring to FIGS. 5 and 6, the first radiator 31 and the second radiator 33 may be excited by being fed with the same electricity from the same feeder F. When the same electricity is fed to the first radiator 31 and the second radiator 33, a (electrical) length of a path through which current flows to the first radiator 31 and the second radiator 33 may be longer in the first radiator 31 than in the second radiator 33. Since the electrical length of the radiator may be set to ¼ of a wavelength of a resonance frequency, a wavelength of the resonance frequency of the first radiator 31 may be longer than that of a wavelength of the resonance frequency formed of the second radiator 33. Thus, in the antenna device 30 according to the current embodiment of the present disclosure, the second radiator 33 may have a higher resonance frequency than that of the first radiator 31.

Figure 7:
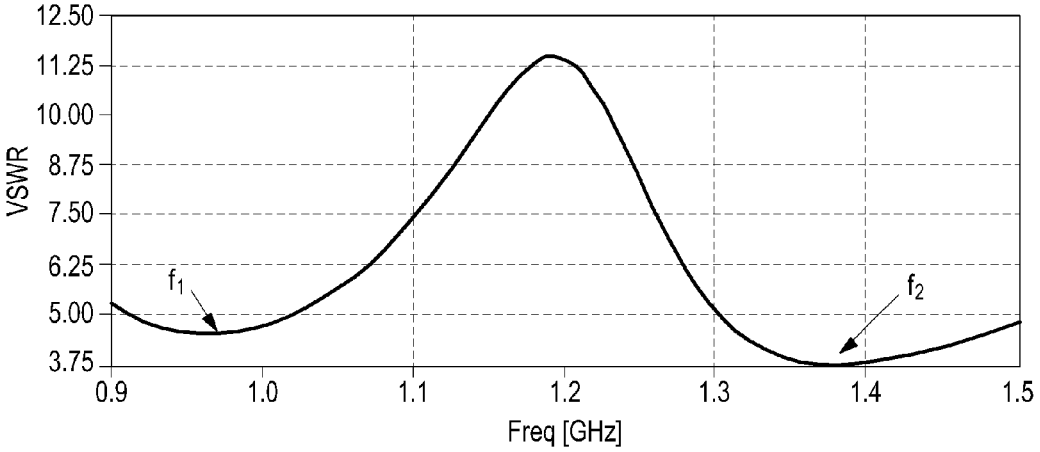
FIG. 7 is a graph showing resonance characteristics of an antenna device according to an embodiment of the present disclosure.

FIG. 7 is a graph showing resonance characteristics of the antenna device 30 according to an embodiment of the present disclosure.

Referring to FIG. 7, a measurement result of a VSWR of the antenna device 30 is illustrated, from which it can be seen that the antenna device 30 forms a first resonance frequency $f_1$ of a frequency band of about 980 MHz and a second resonance frequency $f_2$ of a frequency band of about 1.4 GHz. The first resonance frequency $f_1$ may be formed by the first radiator 31 and the second resonance frequency $f_2$ may be formed by the second radiator 33. The first radiator 31 and the second radiator 33 are excited by being fed with the same electricity, such that interference caused by coupling between signal currents flowing through the first radiator 31 and the second radiator 33 may be suppressed even when the first radiator 31 and the second radiator 33 are disposed adjacent to each other. For example, the first radiator 31 and the second radiator 33 may stably maintain their independent radiation performances, while being disposed adjacent to each other.

Figure 8:
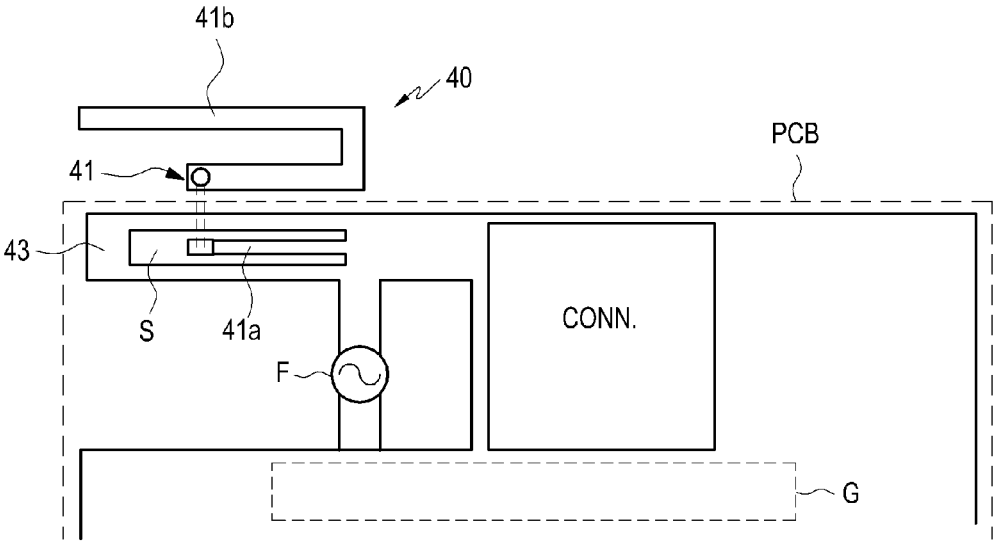
FIG. 8 is a diagram of an antenna device according to an embodiment of the present disclosure.

FIG. 8 is a diagram of an antenna device 40 according to an embodiment of the present disclosure.

Referring to FIG. 8, at least a portion 41*a*, for example, a first conductive pattern 41*a*, of a first radiator 41 of the antenna device 40 may be disposed in a slot S formed in a second radiator 43. Another portion 41*b*, for example, a second conductive pattern 41*b*, of the first radiator 41 may be disposed outside the slot S. For example, the first conductive pattern 41*a* of the first radiator 41 may be disposed in the slot S and the second conductive pattern 41*b* of the first radiator 41 may be disposed outside the slot S, and the first conductive pattern 41*a* and the second conductive pattern 41*b* may be connected to each other through a path detouring around a conductive pattern of the second radiator 43. The path for connecting the first conductive pattern 41*a* and the second conductive pattern 41*b* may include a conductive pattern formed on a different PCB layer than the conductive pattern of the second radiator 43. The second conductive pattern 41*b* may be formed on a region or layer that is different from a region where the first conductive pattern 41*a* or the second radiator 43 is formed on the multi-layer PCB, and may be provided on a separate structure. A case where the second conductive pattern 41*b* is provided on the separate structure will be described in more detail below.

On the multi-layer PCB, various forms of conductive patterns may be provided, and the conductive pattern of the second radiator 43 may be connected to a connection member provided on the multi-layer PCB, for example, a connector member CONN. If the connector member CONN is connected to the second radiator 43 through a conductive pattern, the connector member CONN may be used as a portion of the antenna device 40. A portion of the conductive pattern formed on the multi-layer PCB may be used as the first radiator 41 and the second radiator 43, and another portion of the conductive pattern may provide a ground G Signal lines connected to the connector member CONN may also be implemented as another conductive pattern (not shown).

Figure 9:
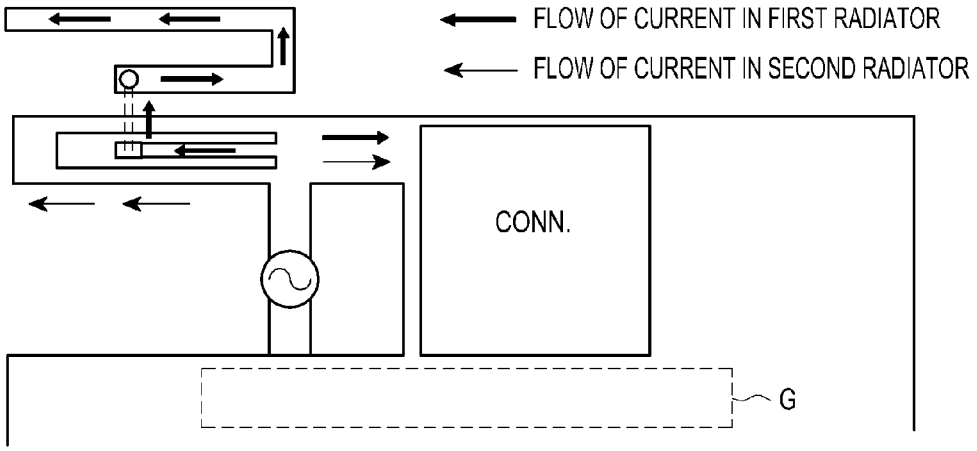
FIG. 9 is a view illustrating a flow of a signal current of an antenna device according to an embodiment of the present disclosure.

FIG. 9 is a view illustrating a flow of a signal current of the antenna device 40 according to of the present disclosure.an embodiment Referring to FIGS. 8 and 9, the first radiator 41 and the second radiator 43 may be excited by being fed with the same electricity from the same feeder F. When the same electricity is fed to the first radiator 41 and the second radiator 43, a (electrical) length of a path through which current flows to the first radiator 41 and the second radiator 43 may be longer in the first radiator 41 than in the second radiator 43. The electrical length of the radiator may be set to ¼ of a resonance frequency wavelength such that the wavelength of a resonance frequency formed by the first radiator 41 may be longer than a wavelength of a resonance frequency of the second radiator 43. Thus, in the antenna device 40 according to the current embodiment, the second radiator 43 may form the resonance frequency in a higher frequency band than that of the first radiator 41.

Figure 10:
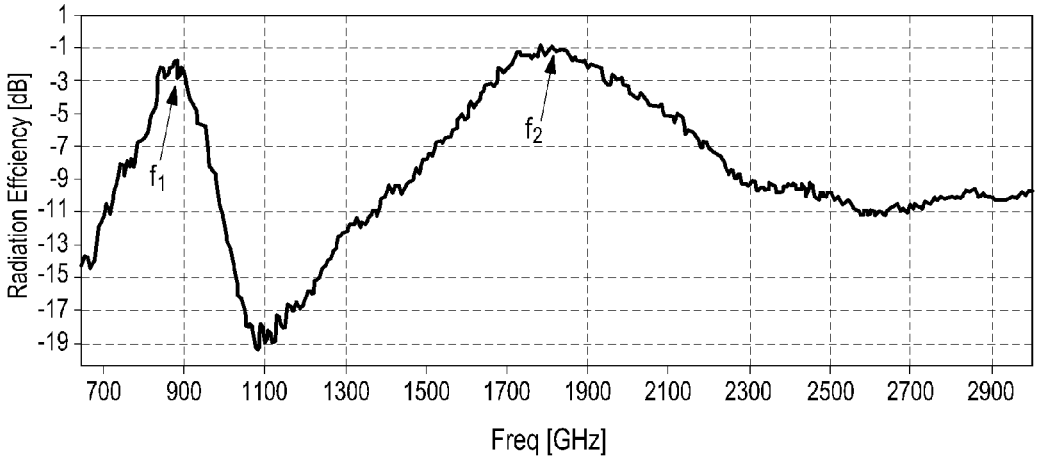
FIG. 10 is a graph showing of radiation efficiency of an antenna device according to an embodiment of the present disclosure.

FIG. 10 is a graph showing resonance characteristics of the antenna device 40 according to an embodiment of the present disclosure.

Referring to FIG. 10, a measurement result of a radiation efficiency of the antenna device 40 is illustrated, from which it can be seen that the antenna device 40 forms a first resonance frequency $f_1$ of a frequency band of about 900 MHz and a second resonance frequency $f_2$ of a frequency band of about 1.8 GHz. The first resonance frequency $f_1$ may be formed by the first radiator 41 and the second resonance frequency $f_2$ may be formed by the second radiator 43. The first radiator 41 and the second radiator 43 are excited by being fed with the same electricity, such that interference caused by coupling between signal currents flowing through the first radiator 41 and the second radiator 43 may be suppressed even when the first radiator 41 and the second radiator 43 are disposed adjacent to each other. For example, the first radiator 41 and the second radiator 43 may stably maintain their independent radiation performances, while being disposed adjacent to each other.

Figure 11:
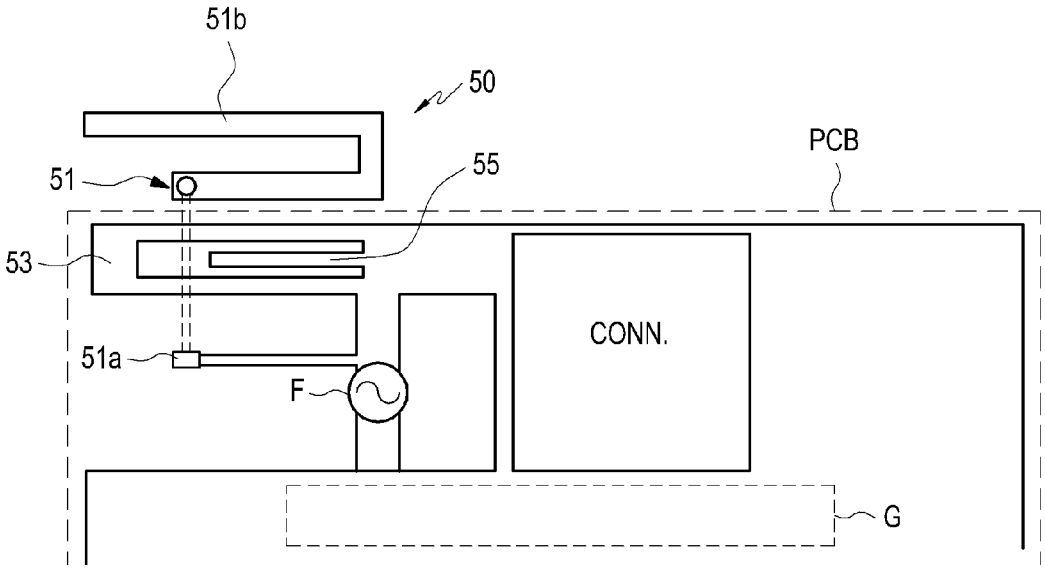
FIG. 11 is a diagram of an antenna device according to an embodiment of the present disclosure.

FIG. 11 is a diagram of an antenna device 50 according to an embodiment of the present disclosure.

Referring to FIG. 11, the antenna device 50 may include a first radiator 51, a second radiator 53, and a third radiator 55 that operate independently of one another, for example, form resonance frequencies in different frequency bands, and the third radiator 55 may be disposed in the slot S, which is formed in the second radiator 53.

The first radiator 51, the second radiator 53, and the third radiator 55 may include conductive patterns formed on the multi-layer PCB, respectively. The first radiator 51 may include a first conductive pattern 51*a* and a second conductive pattern 51*b* formed at different sides of the second radiator 53, and the first conductive pattern 51*a* and the second conductive pattern 51*b* may be connected to each other through a conductive pattern formed on a layer that is different from that on which the second radiator 53 is formed. The slot S may be formed in the second radiator 53, and the third radiator 55 may be formed in the slot S. The first radiator 51, the second radiator 53, and the third radiator 55 may be fed with the same electricity from the same feeder F, and the second radiator 53 may be connected to the connector member CONN. For example, the connector member CONN may form a portion of the antenna device 50. Since the first radiator 51, the second radiator 53, and the third radiator 55 are excited by being fed with the same electricity, interference caused by coupling between signal currents flowing through the first radiator 51, the second radiator 53, and the third radiator 55 may be suppressed even when the first radiator 51, the second radiator 53, and the third radiator 55 are disposed adjacent to one another. For example, the first radiator 51, the second radiator 53, and the third radiator 55 may stably maintain their independent radiation performances while being disposed adjacent to one another.

Figure 12:
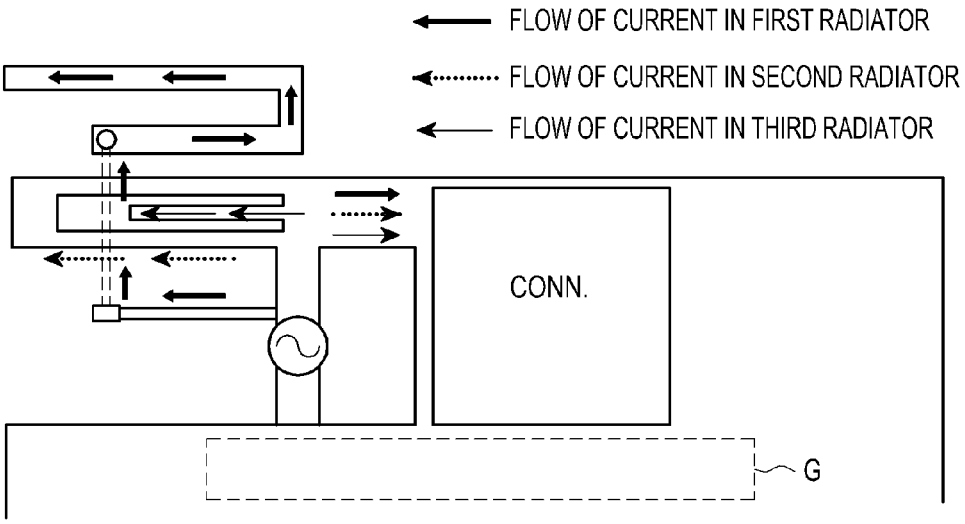
FIG. 12 is a view illustrating a flow of a signal current of an antenna device according to an embodiment of the present disclosure.

FIG. 12 is a view illustrating a flow of a signal current of the antenna device 50 according to of the present disclosure.an embodiment Referring to FIGS. 11 and 12, the first radiator 51 may have a longer electrical length than the second radiator 53. The second radiator 53 may have a longer electrical length than the third radiator 55. The first radiator 51 and the second radiator 53 may form resonance frequencies in different frequency bands. For example, the first radiator 51 forms a first resonance frequency $f_1$ of a frequency band of about 1 GHz, and the second radiator 53 forms a second resonance frequency $f_2$ of a frequency band of about 2 GHz. The third radiator 55 is disposed in the slot S and forms a third resonance frequency $f_3$ without affecting operations of the first radiator 51 and the second radiator 53. For example, the third radiator 55 may form the third resonance frequency $f_3$ of a frequency band of about 2.7 GHz. The resonance frequency bands of the antenna device 50 will be described in more detail with reference to FIG. 13.

Figure 13:
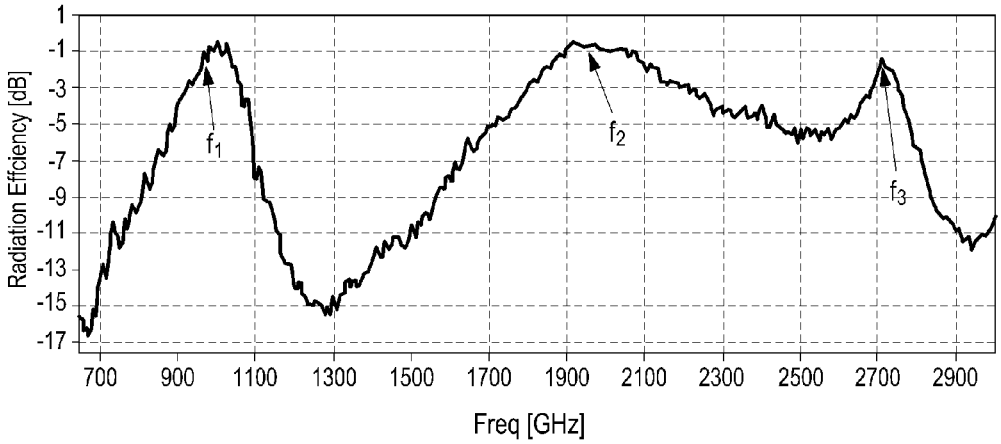
FIG. 13 is a graph showing radiation efficiency of an antenna device according to an embodiment of the present disclosure.

FIG. 13 is a graph showing radiation efficiency of the antenna device according to an embodiment of the present disclosure.

Referring to FIG. 13, a graph illustrates radiation efficiency of the antenna device 50, from which it can be seen that the antenna device 50 forms the first resonance frequency $f_1$ of the frequency band of about 1 GHz and the second resonance frequency $f_2$ of the frequency band of about 2 GHz. It can also be seen that the antenna device 50 forms the third frequency $f_3$ of the frequency band of about 2.7 GHz by including the third radiator 55. Since the first radiator 51, the second radiator 53, and the third radiator 55 are excited by being fed with the same electricity, interference caused by coupling between signal currents flowing through the first radiator 51, the second radiator 53, and the third radiator 55 may be suppressed even when the first radiator 51, the second radiator 53, and the third radiator 55 are disposed adjacent to one another. For example, the first radiator 51, the second radiator 53, and the third radiator 55 may stably maintain their independent radiation performances, while being disposed adjacent to one another and forming resonance frequencies in different frequency bands.

As described above, an antenna device according to various embodiments of the present disclosure may include a first radiator in which a slot is formed, a second radiator, at least a portion of which is disposed in the slot, and a feeder configured to feed the same electricity to the first radiator and the second radiator.

According to various embodiments of the present disclosure, the second radiator may be entirely disposed in the slot and the second radiator may form a resonance frequency in a higher frequency band than a frequency band in which the first radiator forms a resonance frequency.

According to various embodiments of the present disclosure, a portion of the second radiator may be disposed in the slot, another portion of the second radiator may be disposed outside the slot, and the second radiator may form a resonance frequency in a lower frequency band than a frequency band in which the first radiator forms a resonance frequency.

According to various embodiments of the present disclosure, the second radiator may include a conductive pattern extending from the first radiator into the slot.

According to various embodiments of the present disclosure, the first radiator may be fed with the electricity by forming capacitive coupling with the feeder.

Figure 14:
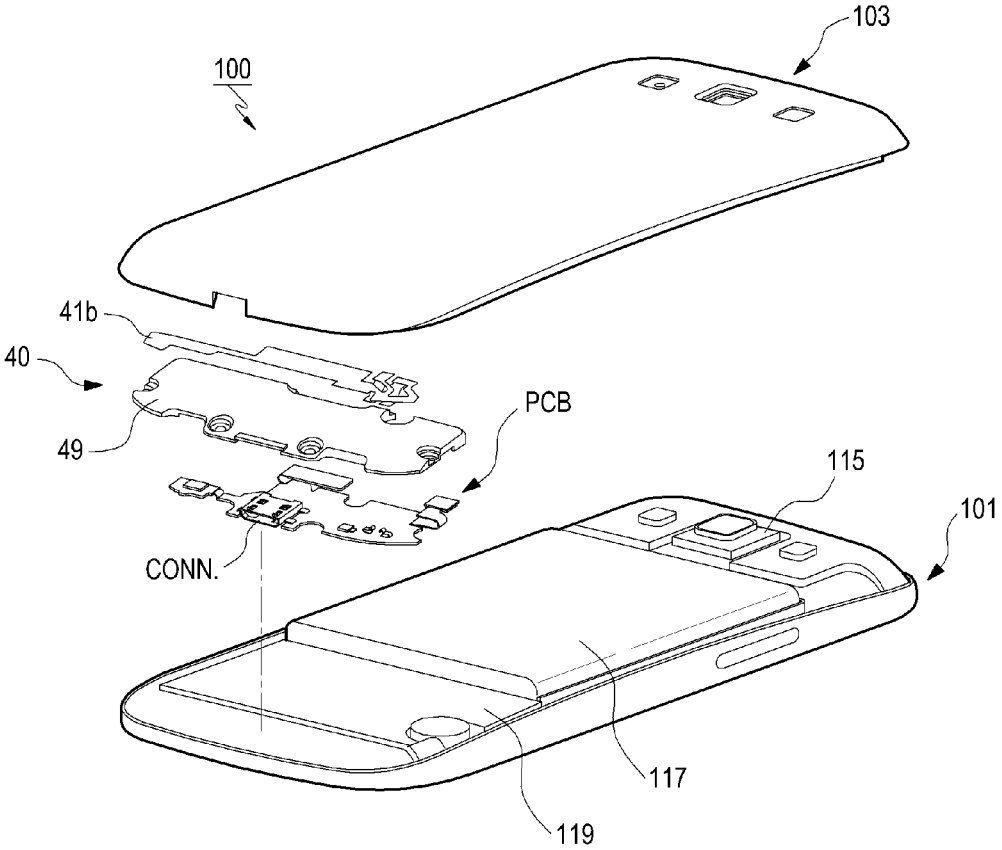
FIG. 14 is an exploded perspective view showing an electronic device including an antenna device according to various embodiments of the present disclosure.

FIG. 14 is an exploded perspective view illustrating an electronic device including an antenna device according to various embodiments of the present disclosure.

An electronic device according to various embodiments of the present disclosure may be a device including a communication function. For example, the electronic device may include at least one of a smart phone, a tablet personal computer (PC), a mobile phone, a video phone, an electronic book (e-book) reader, a desktop PC, a laptop PC, a netbook computer, a PDA, a PMP, an moving picture experts group (MPEG) audio layer 3 (MP3) player, mobile medical equipment, an electronic bracelet, an electronic necklace, an electronic appcessory, a camera, a wearable device (for example, a head-mounted device (HMD) such as electronic glasses), an electronic cloth, an electronic bracelet, an electronic necklace, an electronic tattoo, and a smart watch.

According to various embodiments, the electronic device may be a smart home appliance having a communication function. The electronic device may include at least one of a TV, a digital versatile disc (DVD) player, audio equipment, a refrigerator, an air conditioner, a vacuum cleaner, an oven, a microwave oven, a laundry machine, an air cleaner, a set-top box, a TV box (for example, Samsung HomeSync™, Apple TV™, or Google TV™), a game console, an electronic dictionary, an electronic key, a camcorder, and an electronic frame.

According to various embodiments, the electronic device may include at least one of various medical equipment (for example, magnetic resonance angiography (MRA), magnetic resonance imaging (MRI), computed tomography (CT), an imaging device, or an ultrasonic device), a navigation system, a global positioning system (GPS) receiver, an event data recorder (EDR), a flight data recorder (FDR), a vehicle infotainment device, electronic equipment for ships (for example, navigation system and gyro compass for ships), avionics, a security device, a vehicle head unit, and an industrial or home robot.

According to various embodiments, the electronic device may include at least one of a part of a furniture or building/structure having a communication function, an electronic board, an electronic signature receiving device, a projector, and various measuring instruments (for example, a water, electricity, gas, or electric wave measuring device). The electronic device according to various embodiments of the present disclosure may be one of the above-listed devices or a combination thereof. It will be obvious to those of ordinary skill in the art that the electronic device according to various embodiments of the present disclosure is not limited to the above-listed devices.

Referring to FIG. 14, the electronic device 100 (for example, the electronic device 10) includes an antenna device according to various embodiments of the present disclosure. The electronic device 100 may include a removable battery pack 117 that is provided on a rear surface of a housing 101, a camera module 115 disposed on a side of a region where the battery pack 117 is mounted, an a main PCB 119 disposed on another side of the removable battery pack 117. The electronic device 100 may protect the battery pack 117 by including a cover member 103 that is fixed to the rear surface of the housing 101.

The antenna device included in the electronic device 100 may be an antenna device according to one of the above-described various embodiments of the present disclosure. When the antenna device included in the electronic device 100 is described, a structure that is the same as or similar to that of the antenna device according to one of the various embodiments of the present disclosure will be described with the same reference numeral as used in the corresponding embodiment.

Figure 15:
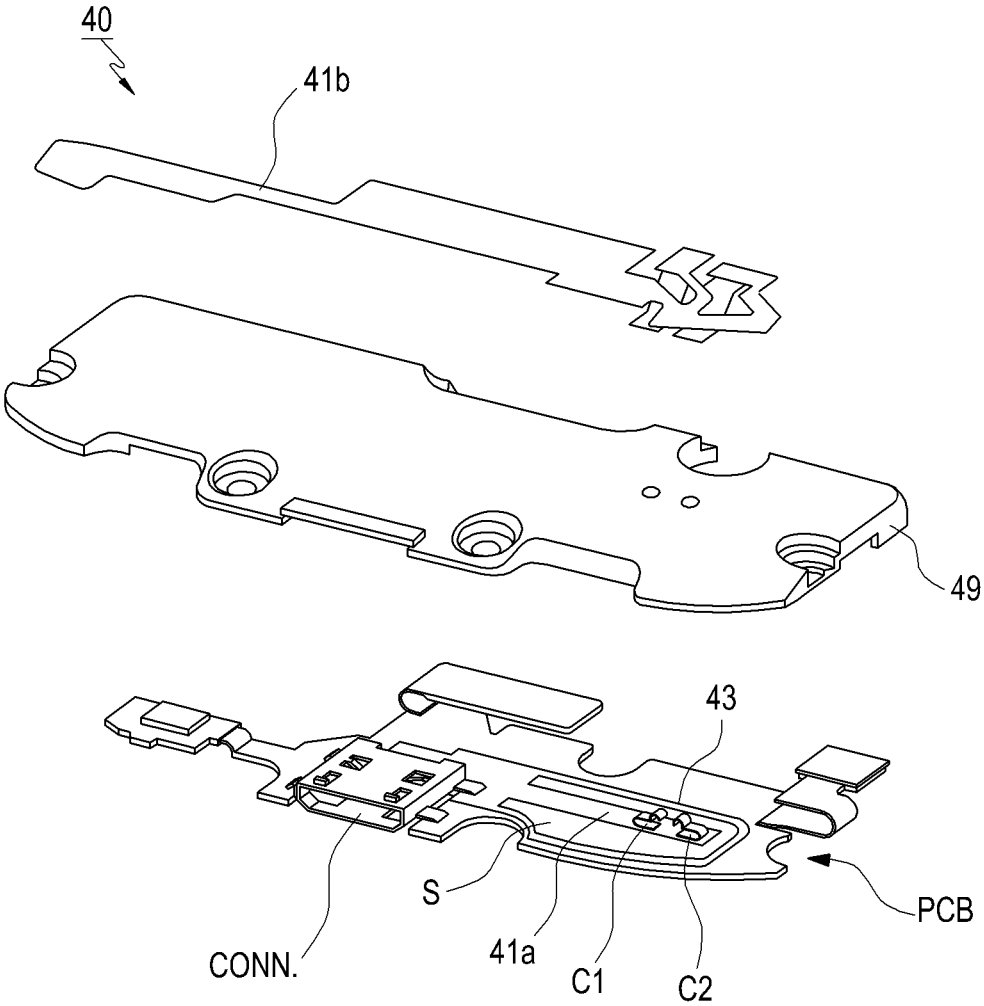
FIG. 15 is an exploded perspective view showing a part of an electronic device including an antenna device according to various embodiments of the present disclosure.

FIG. 15 is an exploded perspective view illustrating a portion of the electronic device 100 including an antenna device according to various embodiments of the present disclosure.

Referring to FIGS. 14 and 15, the antenna device 40 may include an auxiliary PCB and a carrier 49, and may be disposed adjacent to the main PCB 119. According to various embodiments, the auxiliary PCB may be configured as a part of the main PCB 119. On the auxiliary PCB, a connection member, for example, the connector member CONN may be mounted to provide a connection means for an external device, such as a charging device. The auxiliary PCB and the carrier 49 may be used as structures where the above-described elements of the antenna device 40, for example, the first radiator 41 and the second radiator 43 may be installed. The carrier 49 may receive another electronic part, for example, a speaker phone, and provide a resonance space for the speaker phone.

The auxiliary PCB may be configured as a multi-layer PCB and may include conductive patterns of the first radiator 41 and the second radiator 43. The conductive patterns formed on the auxiliary PCB may provide the first radiator 41, the second radiator 43, and a ground or various signal lines connected to the connector member CONN. The auxiliary PCB may include at least one connection terminal, for example, C clips C1 and C2. The C clips C1 and C2 may be mounted on the conductive patterns formed on the auxiliary PCB.

The first radiator 41 may include the first conductive pattern 41*a* formed on the auxiliary PCB and the second conductive pattern 41*b* disposed on the carrier 49. When the auxiliary PCB and the carrier 49 are mounted on the housing 101, the carrier 49 may be disposed facing the auxiliary PCB. To connect the second conductive pattern 41*b* with the first conductive pattern 41*a*, a connection terminal, for example, the C clips C1 and C2 may be disposed on the first conductive pattern 41*a* for connection between the first conductive pattern 41*a* and the second conductive pattern 41*b*. A portion of the second conductive pattern 41*b* extends downward, enclosing one side of the carrier 49, thus being disposed corresponding to the C clips C1 and C2. According to various embodiments, the second conductive pattern 41*b* may be formed as a leaf-spring structure under the carrier 49 to directly contact the first conductive pattern 41*a*. If the second conductive pattern 41*b* is configured to directly contact the first conductive pattern 41*a*, the C clips C1 and C2 may not have to be installed.

The second radiator 43 may be formed as a closed-curve conductive pattern formed on the auxiliary PCB. Since the second radiator 43 is formed as the closed-curve conductive pattern, the slot S may be formed in the second radiator 43. A portion of the first radiator 41, for example, the first conductive pattern 41*a* may be disposed in the slot S. An end of the first conductive pattern 41*a* may be connected to the second radiator 43 and may extend from the inside of the slot S. The C clips C1 and C2 may electrically connect the first conductive pattern 41 and the second conductive pattern 43 by providing a path around the conductive pattern of the second radiator 43. The conductive pattern of the second radiator 43 may extend to a region where the connector member CONN is mounted. For example, the connector member CONN may be electrically connected with the second radiator 43. As the connector member CONN is electrically connected to the second radiator 43, the connector member CONN may be used as a part of the antenna device 40.

The first radiator 41 and the second radiator 43 are disposed at least partially in adjacent to each other and may be fed with the same electricity. Since first radiator 41 and the second radiator 43 are excited with the same electricity, interference caused by coupling between signal currents flowing through the first radiator 41 and the second radiator 43 may be suppressed even when the first radiator 41 and the second radiator 43 are disposed adjacent to each other. For example, the first radiator 41 and the second radiator 43 may stably maintain their independent radiation performances while being disposed adjacent to each other and forming resonance frequencies in different frequency bands. In addition, by disposing the entire first radiator 41 or a portion thereof in the slot S formed in the second radiator 43, a space needed for installation of the antenna device 40 may be reduce.

As described above, an electronic device according to various embodiments of the present disclosure may include a first radiator in which a slot is formed, and a second radiator, at least a portion of which is disposed in the slot, and which is fed with the same electricity as electricity fed to the first radiator, in which the first radiator and the second radiator form resonance frequencies in different frequency bands.

According to various embodiments of the present disclosure, the electronic device may further include a PCB in which a conductive pattern forming the first radiator is formed and a connection member provided on the PCB, in which the connection member is electrically connected to the conductive pattern.

According to various embodiments of the present disclosure, the electronic device may further include a PCB in which the first radiator is formed, a carrier disposed facing the PCB, a first conductive pattern formed in the slot, a connection terminal provided on the first conductive pattern, and a second conductive pattern provided on the carrier, in which the first conductive pattern and the second conductive pattern are connected through the connection terminal to form the second radiator.

According to various embodiments of the present disclosure, the first radiator may have a resonance frequency than the second radiator.

According to various embodiments of the present disclosure, the second radiator may include a conductive pattern formed in the slot, and the second radiator may have a higher resonance frequency than the first radiator.

According to various embodiments of the present disclosure, the first radiator and the second radiator may be fed with the same electricity.

As is apparent from the foregoing description, an antenna device according to various embodiments of the present disclosure forms a slot in one radiator and receives the entire another radiator or at least a part thereof in the slot, thereby disposing the plurality of radiators in the same installation space and forming resonance frequencies in different frequency bands. For example, the antenna device according to various embodiments of the present disclosure enables wireless communication in various frequency bands while being installed within a limited space of the electronic device, allowing efficient use of the internal space of the electronic device. Moreover, since two different radiators are fed with the same electricity while being disposed adjacent to each other, interference between the radiators may be prevented and the radiation performances of the radiators may be maintained stably.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna device comprising:

a printed circuit board (PCB) provided with a first conductive pattern on a surface of the PCB;

a first radiator formed by a portion of the first conductive pattern;

a slot formed in the first radiator;

a second radiator comprising:

a first portion disposed inside the slot, and a second portion disposed outside the slot;

a carrier disposed facing the PCB and provided with a second conductive pattern; and a feeder configured to feed the same electricity to the first radiator and the second radiator, wherein another portion of the first conductive pattern is disposed in the slot such that the other portion of the first conductive pattern forms the first portion of the second radiator, and wherein the second conductive pattern is connected to the other portion of the first conductive pattern such that the second conductive pattern forms the second portion of the second radiator.

2. The antenna device of claim 1, wherein the second radiator has a lower resonance frequency than the first radiator.

3. The antenna device of claim 1, wherein the other portion of the first conductive pattern is planar with the first radiator, and wherein the second conductive pattern is disposed on a different layer than the first radiator.

4. The antenna device of claim 1, wherein the other portion of the first conductive pattern extends from the first radiator into the slot.

5. The antenna device of claim 4, wherein the first radiator is fed with the electricity by forming capacitive coupling with the feeder.

6. An electronic device comprising:

a printed circuit board (PCB) provided with a first conductive pattern on a surface of the PCB;

a first radiator formed by a portion of the first conductive pattern;

a slot formed in the first radiator;

a second radiator, fed with the same electricity fed to the first radiator, configured such that at least a portion of the second radiator is disposed inside the slot; and a carrier disposed facing the PCB and provided with a second conductive pattern, wherein another portion of the first conductive pattern is disposed in the slot such that the other portion of the first conductive pattern forms the at least the portion of the second radiator disposed inside the slot, wherein the second conductive pattern is connected to the other portion of the first conductive pattern such that the second conductive pattern and the other portion of the first conductive pattern form the second radiator, and wherein the first radiator and the second radiator have resonance frequencies in different frequency bands.

7. The electronic device of claim 6, further comprising:

a connection member provided on the PCB, wherein the connection member is electrically connected to the first conductive pattern.

8. The electronic device of claim 6, further comprising:

a connection terminal provided on the other portion of the first conductive pattern, wherein the other portion of the first conductive pattern and the second conductive pattern are connected through the connection terminal.

9. The electronic device of claim 8, wherein the other portion of the first conductive pattern is planar with the first radiator, and wherein the second conductive pattern is disposed on a different layer than the first radiator.

10. The electronic device of claim 8, wherein the first radiator has a higher resonance frequency than the second radiator.

11. The electronic device of claim 6, wherein the other portion of the first conductive pattern is planar with the first radiator, and wherein the second conductive pattern is disposed on a different layer than the first radiator.

* * * * *